US008123323B2

(12) United States Patent
Jung

(10) Patent No.: US 8,123,323 B2
(45) Date of Patent: Feb. 28, 2012

(54) ARRAY HEAD TYPE INKJET IMAGE FORMING APPARATUS AND METHOD OF COMPENSATING ALIGNMENT ERRORS THEREOF

(75) Inventor: Dong-kee Jung, Seoul (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 556 days.

(21) Appl. No.: 12/348,365

(22) Filed: Jan. 5, 2009

(65) Prior Publication Data

US 2009/0303272 A1 Dec. 10, 2009

(30) Foreign Application Priority Data

Jun. 5, 2008 (KR) ..... 10-2008-0053184

(51) Int. Cl.
*B41J 29/38* (2006.01)

(52) U.S. Cl. ..... 347/19; 347/14

(58) Field of Classification Search ..... 347/15, 347/14, 19

See application file for complete search history.

(56) References Cited

U.S. PATENT DOCUMENTS

2004/0041863 A1* 3/2004 Ioka et al. ..... 347/10
2006/0132519 A1* 6/2006 Kovacs ..... 347/12
2006/0274099 A1* 12/2006 Jahana et al. ..... 347/15

* cited by examiner

*Primary Examiner* — Laura Martin
(74) *Attorney, Agent, or Firm* — Stanzione & Kim, LLP

(57) ABSTRACT

A method of compensating for alignment errors includes determining a degree of overlap between nozzles of a plurality of head chips; checking driving information corresponding to the determined degree of overlap between nozzles, from a pre-provided compensation table, and controlling the driving of the nozzles in an overlapping area, according to the checked driving information.

23 Claims, 8 Drawing Sheets

| OVERLAPPING OBJECT | DEGREE OF OVERLAP BETWEEN NOZZLES | GRADE | TABLE |
|---|---|---|---|
| #1~2 | $E_1$ | $G_1$ | $T_1$ |
| #2~3 | $E_2$ | $G_2$ | $T_2$ |
| ⋮ | ⋮ | ⋮ | ⋮ |
| #(N-1)~N | $E_{n-1}$ | $G_{n-1}$ | $T_{n-1}$ |

ARRAY HEAD TYPE INKJET IMAGE FORMING APPARATUS AND METHOD OF COMPENSATING ALIGNMENT ERRORS THEREOF

CROSS-REFERENCE TO RELATED APPLICATIONS

This application claims priority under 35 U.S.C. §119(a) of Korean Patent Application No. 10-2008-53184, filed on Jun. 5, 2008, in the Korean Intellectual Property Office, the disclosure of which is incorporated herein by reference in its entirety.

BACKGROUND OF THE INVENTION

1, Field of the Invention

The present general inventive concept relates to an array head type inkjet image forming apparatus and a method of compensating for alignment errors thereof. More particularly, the present general inventive concept relates to an array head type inkjet image forming apparatus which can control driving of nozzles in areas in which head chips overlap with each other, and a method of compensating for alignment errors thereof.

2, Description of the Related Art

An image forming apparatus is an apparatus which prints a color image on the surface of a printing medium by firing minute droplets of printing ink onto a desired location on the printing medium. Inkjet printers can be divided into shuttle type inkjet printers and array head type inkjet printers.

The shuttle type inkjet printer can form an image by projecting printing ink from a printer head reciprocating in a perpendicular direction with respect to a transferring direction of the printing medium. In contrast, the array head type inkjet printer is provided with a printer head having a plurality of head chips. In other words, in the array head type inkjet printer, width of the printer head having a plurality of head chips is equal to or wider than width of the printing medium, so an image can be formed by transferring only the printing medium if the printer head is fixed, or by moving the printer head in the main projecting direction.

In order to prevent degradation of image quality that may occur at the boundaries of the plurality of head chips due to the intervals between the plurality of head chips, the array head type inkjet printer described above is manufactured in order that the plurality of head chips overlap with each other.

In order to prevent the degradation of image quality, the location of the printer to which the plurality of head chips are attached is precisely determined through numerous tests in advance, making it possible to prevent generation of nozzle alignment errors in which the plurality of nozzles provided on the plurality of head chips overlap with each other.

However, since the nozzles overlapping with each other between the plurality of head chips have a radius of no more than several micrometers to several tens of micrometers, it is difficult to attach the head chips minutely in a real manufacturing process such that the nozzle alignment errors can be prevented, and the head chips may therefore be arranged with intervals of less than 1 nozzle in order to generate a white line or a black line on the boundary of the head chips.

In this case, other methods may be performed, attaching the head chip in order to prevent the nozzle alignment errors using more minute apparatus, or measuring the number of overlapping nozzles by directly printing image patterns.

However, considering time, expense, and technological prowess rendered therein, the methods are not economical.

SUMMARY OF THE INVENTION

The present general inventive concept provides an array head type inkjet image forming apparatus which can control driving of nozzles in areas overlapping with each other using a pre-provided compensation table, and a method of compensating for alignment errors thereof.

Additional aspects and utilities of the present general inventive concept will be set forth in part in the description which follows and, in part, will be obvious from the description, or may be learned by practice of the general inventive concept.

The foregoing and/or other aspects and utilities of the present general inventive concept may be achieved by providing a method of compensating for alignment errors in which an array type inkjet image forming apparatus have a plurality of head chips each having a plurality of nozzles, in which some nozzles are arranged so as to overlap with each other, the method comprising determining the degree of overlap between nozzles of the plurality of head chips; checking driving information corresponding to the determined degree of overlap between nozzles, from a previously provided compensation table; and controlling the driving of the nozzles in an overlapping area, according to the checked driving information.

The method may further comprise classifying the state of overlap between nozzles of the head chips into a plurality of grades; drawing up the compensation table by matching different kinds of driving information for each of the plurality of grades; and storing the drawn up compensation table.

The compensation table may include grades to classify the state of overlap between nozzles based on at least one of the number of overlapping nozzles, the direction of overlap, the distance of overlap and the angle of overlap, and the driving information to matching the grades.

In this case, the degree of overlap between nozzles may be determined according to any one of the distance along the X axes, the distance along the Y axes, angles formed between respective X axes, and angles formed between respective Y axes of the plurality of head chips.

The driving information may also include at least one of the nozzle drive rates or nozzle drive patterns.

In this case, the controlling of the driving of the nozzles in the overlapping area may comprise driving the nozzles corresponding to at least one of the driving rates or the driving patterns with respect to at least one head chip of two head chips overlapping with each other, if printing is initiated.

The foregoing and/or other aspects and utilities of the present general inventive concept may be achieved by providing an array head type inkjet image forming apparatus, the apparatus comprising a plurality of head chips each having a plurality of nozzles, in which some nozzles are arranged so as to overlap with each other; a storage unit stored with a compensation table in which driving information corresponding to the degree of overlap between nozzles is recorded; and a control unit to check the driving information corresponding to the degree of overlap between nozzles of the plurality of head chips and to control the driving of the nozzles in an overlapping area according to the checked driving information.

The compensation table may include grades to classify the state of overlap between nozzles based on at least one of the number of overlapping nozzles, the direction of overlap, the distance of overlap and the angle of overlap, and the driving information matching the grades.

Here, the degree of overlap between nozzles may be determined according to any one of the distance along the X axes, the distance along the Y axes, angles formed between respective X axes, and angles formed between respective Y axes, of the plurality of head chips.

The driving information may also include at least one of nozzle drive rates or nozzle drive patterns.

At this time, the control unit may drive the nozzles corresponding to at least one of the driving rates or the driving patterns with respect to at least one head chip of two head chips overlapping with each other, if printing is initiated.

The foregoing and/or other aspects and utilities of the present general inventive concept may be achieved by providing an inkjet image forming apparatus, the apparatus including one or more first nozzles disposed on a first line, one or more second nozzles disposed on a second line, and a control unit to determine a pattern according to an overlap between the one or more first nozzles and the one or more second nozzles, and to drive the one or more first nozzles according to the determined pattern.

The overlap may be a relative position between the first line and the second line.

The overlap may be an angle formed between the first line and the second line.

The overlap may be an area occupied by the one or more first nozzles and the one or more second nozzles.

The overlap may be an overlap amount when the first line and the second line are parallel to each other.

The apparatus may further include a first head chip mounted with the first nozzles, and a second head chip mounted with the second nozzles such that at least a portion of the second head chip overlap the first head chip.

The apparatus may further include a plurality of head chips having a first head chip having the first nozzles and a second head chip having the second nozzles, and the first head chip and the second head chip may be disposed adjacent to each other such that at least one of boundaries and areas of the first head chip and the second head chip overlap.

The apparatus may further include a storage unit having a compensation table to store a plurality of patterns, and the control unit may select one of the plurality of patterns as the pattern according to the overlap.

The control unit may determine the pattern according to the overlap and one of printing modes.

The pattern may include a driving pattern to select a first number of the first nozzles to be used to eject ink to form an image and a second number of the first nozzles to be not used to eject ink, and the first number of the first nozzles and the second number of the first nozzles may alternate along the first line.

The pattern may include a driving pattern to select a first number of the first nozzles to be used to eject ink to form an image and a second number of the first nozzles to be not used to eject ink, and the first number of the first nozzles may be greater than the second number of the first nozzles.

The pattern may include one or more first patterns of the first nozzles to be driven and one or more second patterns of the first nozzles not to be driven, and at least one of the first patterns may be disposed between the second patterns.

The pattern may include one or more first patterns of the first nozzles to be driven and one or more second patterns of the first nozzles not to be driven, and the number of the first patterns may be greater than the number of the second patterns.

The pattern may include the number of selection of the first nozzles to be driven, and the number of selection of the first nozzles is variable along the first line according to a characteristic of the overlap.

The foregoing and/or other aspects and utilities of the present general inventive concept may be achieved by providing a method of an inkjet image forming apparatus, the method including determining a pattern according to an overlap between one or more first nozzles disposed on a first line and one or more second nozzles disposed on a second line, and driving the one or more first nozzles according to the determined pattern.

The foregoing and/or other aspects and utilities of the present general inventive concept may be achieved by providing a computer readable medium to contain computer-readable codes as a program to perform a method of an inkjet image forming apparatus, the method including determining a pattern according to an overlap between one or more first nozzles disposed on a first line and one or more second nozzles disposed on a second line, and driving the one or more first nozzles according to the determined pattern.

BRIEF DESCRIPTION OF THE DRAWINGS

These and/or other aspects and utilities of the present general inventive concept will become apparent and more readily appreciated from the following description of the embodiments, taken in conjunction with the accompanying drawings of which.

DETAILED DESCRIPTION OF THE PREFERRED EMBODIMENTS

Figure 1:
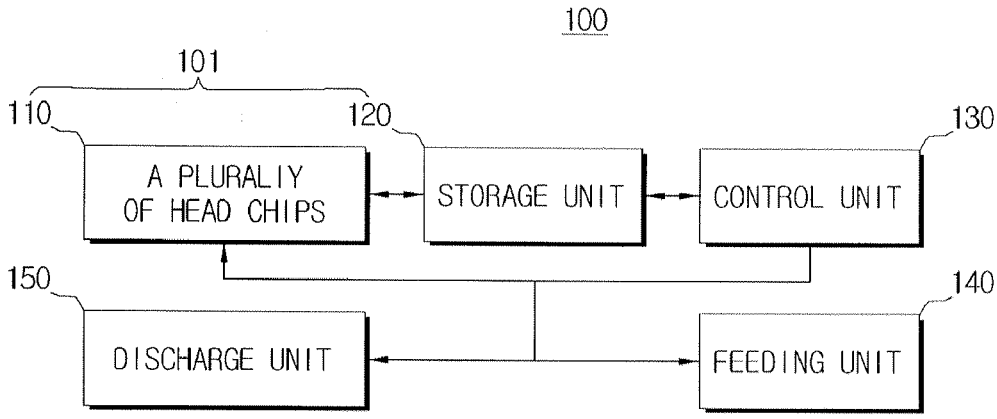
FIG. 1 is a view illustrating an array head type inkjet image forming apparatus according to an exemplary embodiment of the present general inventive concept.

Reference will now be made in detail to the embodiments of the present general inventive concept, examples of which are illustrated in the accompanying drawings, wherein like reference numerals refer to like elements throughout. The embodiments are described below in order to explain the present general inventive concept by referring to the figures.

FIG. 1 is a view illustrating an image forming apparatus 100 according to an exemplary embodiment of the present general inventive concept.

The image forming apparatus 100 may be an inkjet image forming apparatus, a multifunctional image forming apparatus, an array head type inkjet image forming apparatus, etc. Hereinafter, the image forming apparatus 100 may be referred to the array head type inkjet image forming apparatus for the purpose of description of the present general inventive concept.

Referring to FIG. 1, the array head type inkjet image forming apparatus 100 according to an exemplary embodiment of the present general inventive concept includes a plurality of head chips 110, a storage unit 120, and a control unit 130.

The plurality of head chips 110 and the storage unit 120 may form an image forming unit 101 to form an image on a printing medium using ink to be ejected through a plurality of nozzles of the head chips 110 according to information stored in the storage unit 120. The plurality of head chips 110 may be referred to as a printhead (head cartridge, print cartridge, head unit, head assembly, head, etc.) as a portion of the image forming unit 101.

The array head type inkjet image forming apparatus 100 may further include a feeding unit 140 to pick up and feed a printing medium P in a feeding direction D with respect to the printhead, and a discharge unit 150 to discharge the printing medium P after the image forming unit 101 forms the image on the printing medium P.

The control unit 130 may have an interface to communicate with a device to transmit or receive data corresponding to the image to be printed on the printing medium P. The device may be an internal device to scan a document to generate the data, or an external device connectable to the control unit through a wired or wireless communication line to transmit and receive the data corresponding to the image to be printed on the printing medium P.

The plurality of head chips 110 are each provided with a plurality of nozzles, wherein some nozzles are arranged to overlap with each other. If the plurality of head chips are each separated from each other, the plurality of head chips 110 are manufactured and attached to a body of the printhead of the image forming unit 101 in a predetermined pattern. Here, the attached head chips 110 may overlap each other in order to prevent a degradation of image quality that may occur on the printed image on the printing medium P due to one or more gaps between the head chips 110 and/or nozzles, such as one or more white lines. The plurality of nozzles provided in each of the plurality of head chips 110 overlapping other one of the plurality of head chips 110 may thereby overlap other nozzles of the other one of the plurality of head chips 110. The head chips 110 may be disposed in a direction perpendicular to the feeding direction D of the printing medium P. It is possible that the head chips 110 may be disposed on one or more rows which are perpendicular to the feeding direction D and may be disposed in the feeding direction D. The head chips may be disposed in a zigzag pattern along a longitudinal direction of a housing of the printhead to face the printing medium P.

The storage unit 120 includes a compensation table to store driving information corresponding to a characteristic of an overlap between the head chips 110 and/or nozzles. The storage unit 120 may be positioned on a head (or printhead) having the plurality of head chips 100. However, the present general inventive concept is not limited thereto. The storage unit 120 may be disposed to be connectable to the head chips 110 and/or the printhead to control the nozzles of the head chips 110 according to the present general inventive concept. The compensation table may store different driving information to correspond to the respective head chips to control the nozzles of the corresponding one of the head chips 110 in different modes, rates, or patterns.

The overlap of the head chips and/or nozzles may be an angle formed between a reference lines of the head chips and/or nozzles, or an angle formed between lines on which one or more nozzles are disposed in corresponding head chips. The overlap of the head chips and/or nozzles may be a distance between a reference line and a location of a nozzle with respect to the reference line. The overlap of the head chips may be an amount (area) commonly occupied by adjacent nozzles. However, the present general inventive concept is not limited thereto. The overlap of the head chips and/or nozzles may be a relative characteristic of the head chips and/or nozzles. Hereinafter, the overlap of the head chips and/or nozzles may be referred to as "degree of overlap," for the purpose of descriptions of the present general inventive concept.

The degree of the overlap may be constant with respect to the feeding direction D of the printing medium, or may vary with respect to the feeding direction D of the printing medium P.

Here, the degree of overlap between nozzles and/or head chips refers to the degree that nozzles each included in different chips overlap each other. The degree of overlap between nozzles may be determined according to any one of the distance along the X axes, the distance along the Y axes, angles formed between respective X axes, and angles formed between respective Y axes of the plurality of head chips 100.

The degree of overlap between nozzles and/or head chips may measure the degree of overlap between arrangements of each of the plurality of head chips 100 using an optical microscope, if the plurality of head chips 100 are attached to the head. Here, locations where each of the head chips is to be disposed are already determined through numerous tests in advance. If the degree of overlap between arrangements of each of the plurality of head chips is measured as the distance along the X axes, the distance along the Y axes, the angles formed between respective X axes, and the angles formed between respective Y axes of the plurality of head chips 100, the degree of overlap between nozzles each included in the head chips may be checked.

If a measurement command from a user is input to the array head type inkjet image forming apparatus, the degree of overlap between nozzles may be measured using a measuring unit, and if the head (or cartridge) is mounted on the array head type inkjet image forming apparatus, the degree of overlap between nozzles and/or head chips may also be automatically measured using a charge coupled device (CCD) or a CMOS image sensor (CIS) as the measuring unit which is disposed inside the array head type inkjet image forming apparatus. However, it is possible that the measuring unit may be disposed outside the array head type inkjet image forming apparatus to detect the degree of the overlap.

The driving information may include at least one of diverse nozzle drive patterns according to nozzle drive rates. A separate control signal may be input to each of the plurality of nozzles provided on each of the plurality of head chips 100, making it possible to turn each nozzle on or off separately. The nozzle drive rates and the nozzle drive patterns may thereby be formed.

The compensation table may be a table in which all information used for selecting diverse nozzle drive rates and nozzle drive patterns in order to prevent degradation of image quality is stored. In other words, the compensation table may include grades to classify the state of overlap between nozzles based on at least one of the number of overlapping nozzles, the direction of overlap, the distance of overlap and angles of overlap, and the driving information matching the grades, such as the nozzle drive rates and nozzle drive patterns.

The control unit 130 checks driving information corresponding to the degree of overlap between nozzles of the plurality of head chips 100, and controls the driving of the nozzles in the overlapping area according to the checked driving information.

Here, the overlapping area means an area overlapping between adjacent head chips. Even if the adjacent head chips overlap with each other in a manufacturing process, if printing is performed on a printing medium, white lines without overlap may occur between nozzles of the adjacent head chips.

Figure 2:
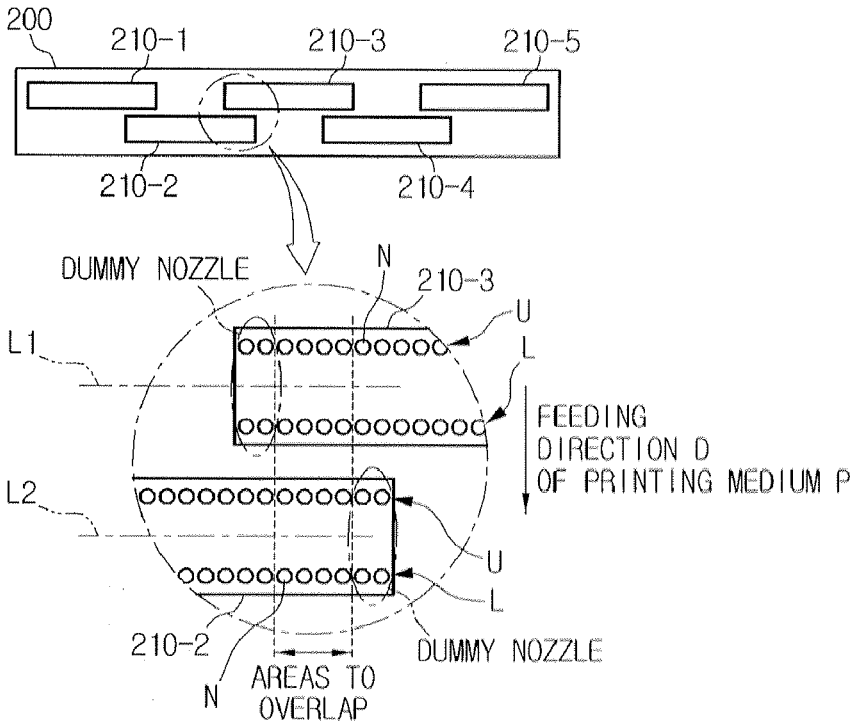
FIG. 2 is a detailed view illustrating a plurality of head chips to overlap each other.

FIG. 2 is a view illustrating an array head 200 having a plurality of head chips to overlap each other.

Referring to FIG. 2, the array head 200 may have a plurality of first to fifth head chips 210-1 to 210-5 attached a body (housing) thereof. The head chips 210-1 to 210-5 may be disposed on corresponding ones of lines L1 and L2, for example. If a printing medium P moves in a printing direction D while the inkjet head 200 is fixed or stationary with respect to the image forming unit 101 of FIG. 1, both left and right ends of each of the head chips may overlap with respect to the printing medium P. The nozzles included on each of the head chips may thereby overlap each other.

Referring to FIG. 2, a portion between the second head chip 210-2 and the third head chip 21-3 is magnified. A plurality of nozzles N are included between the second head chip 210-2 and the third head chip 210-3. The plurality of nozzles form two lines, including an upper line U and a lower line L. However, the present general inventive concept is not limited thereto. It is possible that the plurality of nozzles may have different arrangement with respect to the body of the print head, for example, disposed on a single line in the center portion of the head chips 210-2 and 210-3.

A right-hand edge of the second head chip 210-2 and a left-hand edge of the third head chip 210-3 may be one or more dummy nozzles. These dummy nozzles are formed not to perform a printing by projecting ink through nozzles but to prevent printing defects which may occur from the edges of the chips. Therefore, as illustrated in FIG. 2, areas of the chips to overlap each other may be areas in which the second head chip 210-2 and the third head chip 210-3 overlap each other, rather than an area between the right-hand edge of the second head chip 210-2 and the left-hand edge of the third head chip 210-3.

FIGS. 3A to 3E are views illustrating head chips having nozzles.

Figure 3A:
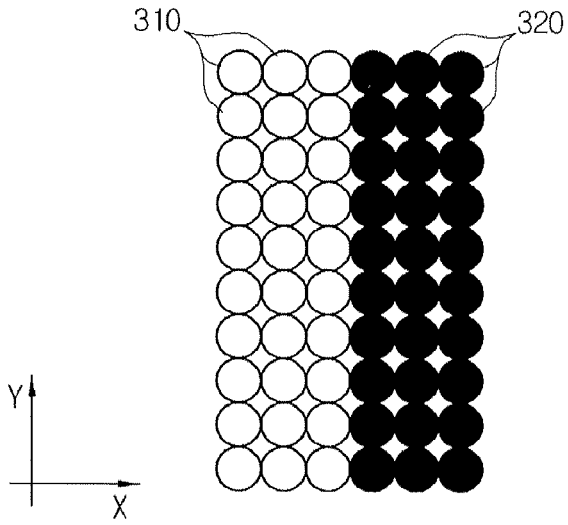
FIGS. 3A to 3E are views illustrating overlap areas of head chips.

Referring to FIG. 3A, the boundaries of first head chips 310 and second head chips 320 are aligned in a predetermined manner without nozzle alignment errors between nozzles of the first head chips 310 and nozzles of the second head chips 320.

Figure 3B:
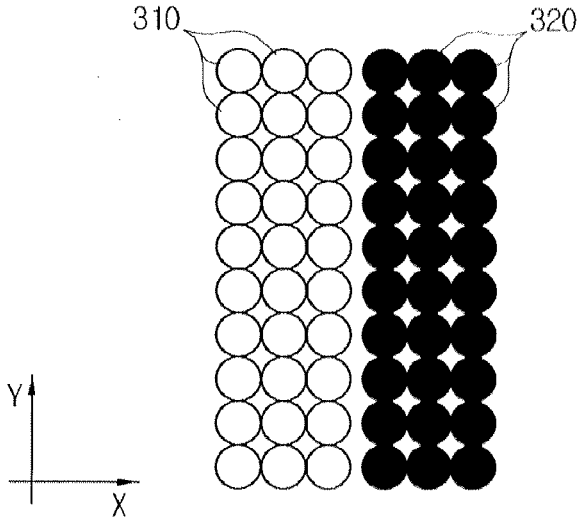

Referring to FIG. 3B, the first head chips 310 and the second head chips 320 are spaced apart from each other horizontally, that is, in the direction perpendicular to the feeding direction D, so vertical white lines may occur on an image to be printed on the printing medium P. The first head chips 310 and the second head chips 320 are spaced apart from each other horizontally by a distance less than a diameter of one nozzle and greater than 0, As an example, the degree of overlap between nozzles thereby may have values of −0.A. Here, the negative sign (−) of "−0.A" represents that the overlap does not occur between actual nozzles.

"A" of "−0.A" may be measured as a ratio of an area of overlap between nozzles to the entire area of one nozzle. However, since white lines occur, overlap may not occur between the nozzles of the head chips mounted on the print head. Therefore, by way of example, if virtual nozzles are formed on the right-hand of the nozzles arranged in the right-most columns (on the Y axis) of the first head chips 310 on the boundaries between the first head chips 310 and the second head chips 320, the values to the right of a decimal point of the degree of overlap between nozzles may be measured using the areas overlapping with the second head chips 320.

Figure 3C:
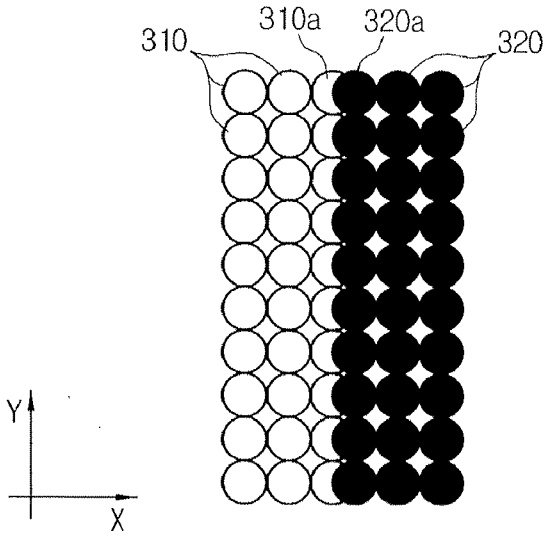

Referring to FIG. 3C, at least one interval may be formed between the first head chips 310 and the second head chips 320 overlapping each other horizontally, so vertical black lines may occur on an image to be printed on the printing medium P. By way of example, the degree of overlap between nozzles may be represented as 1.5, which indicates that either horizontally or vertically nozzles of the first head chips and the second head chips overlap each other, wherein nozzles 310*a* of the first head chips 310 overlap nozzles 320*a* of the second head chip 320 partially so that 50% of the entire areas of the nozzles overlap with other nozzles.

Figure 3D:
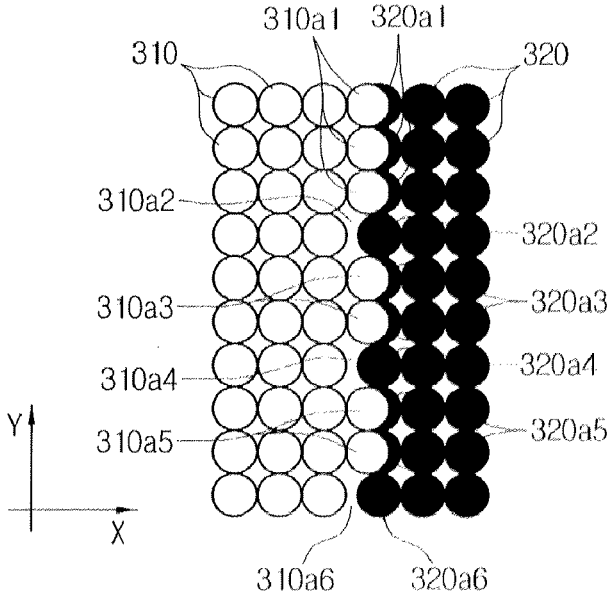

Referring to FIG. 3D, portions 310*a*1 and 310*a*2 of the plurality of nozzles of the first head chip 310 may be turned on in order to compensate for nozzle alignment errors in FIG. 3B in which vertical white lines occur. A plurality of sub-nozzles 320*a*1 and 32-*a*3 are provided in each of the head chips, so a predetermined number of sub-nozzles may be driven as the resolution increases. A nozzle 320*a* of the second head chip 320 can be selected to be turned while one of the nozzles of the first head chip 310 corresponding one of the nozzle 320 of the second head chip 320 is not turned on. Here, a predetermined number of nozzles among the ten nozzles arranged vertically on the first head chips 310 are to be turned on and one or more patterns of the nozzles of the ten nozzles are to be driven may be determined using a stored compensation table.

As illustrated in FIG. 3D, the nozzles disposed on a line of the first head chip 310 and the nozzles disposed on a line of the second head chip 320 are selectively used according patterns or ratios. That is, first three nozzles 310*a* from the top of the nozzles of the first head chips 310, fourth and fifth nozzles 310*a*2, and eighth and ninth nozzles 310*a*5 are selected to be used to eject ink, and a fourth nozzle 310*a*2, 310*a*4 and 310*a*6 are not selected to be used to eject ink. First three nozzles 320*a* of the second head chip 320, fourth nozzle 320*a*2, fifth and sixth nozzles 320*a*3, seventh nozzle 320*a*4, eighth and ninth nozzles 320*a*5 and tenth nozzle 320*a*6 can be selectively used to eject ink, according to the pattern or ratio of the nozzles of the respective head chips in a printing operation. Therefore, the pattern or ratio of the first head chip 310 can be different from the pattern or ratio of the second head chip 320.

If a printing operation is initiated in the image forming apparatus 100, the driving of at least one of two adjacent head chips overlapping each other, that is, the first head chips 310 and the second head chips 320, may thereby be controlled. In other words, as illustrated in FIG. 3D, the drive rate and the drive pattern may be selected to drive only the first head chips 310, or may be selected to drive only the second head chips 320. The drive rates and the drive pattern may alternatively be selected using some of the nozzles of the first head chips 310 and some of the nozzles of the second head chips 320.

Figure 3E:
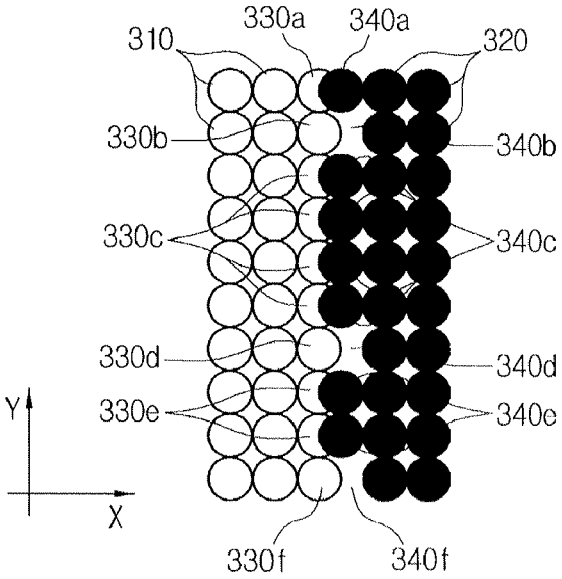

Referring to FIG. 3E, some of the plurality of nozzles of the second head chips 320 may be turned on in order to compensate for nozzle alignment errors in FIG. 3*c* in which vertical black lines.

As illustrated in FIG. 3E, the nozzles disposed on a line of the first head chip 310 and the nozzle disposed on a line of the second head chip 320 are selectively used according patterns or ratios. That is, nozzles 330*a*, 330*b*, 330*c*, 330*d*, 330*e*, and 330*f* of the first head chips 310 are used to eject ink. However, first nozzle 340*a* of the second head chip 320, third to and sixth nozzles 330*c*, and eighth and ninth nozzles 340*e* can be selected to be used to eject ink, and second nozzle 340*b*, seventh nozzle 340*d* and tenth nozzle 340*f* may not be selected to eject ink, according to the pattern or ratio of the nozzles of the respective head chips in a printing operation. Therefore, the pattern or ratio of the first head chip 310 can be different from the pattern or ratio of the second head chip 320. However, the present general inventive concept is not limited thereto. It is possible that a predetermined number of nozzles of the first head chip 310 may be selected to eject ink rather than selecting all nozzles of the first head chips 310 of FIG. 3E.

Referring to FIGS. 3A to 3E, the nozzle drive rates and nozzle drive patterns with respect to errors to the right of a decimal point may vary according to the degree of overlap between nozzles, thereby making it possible to perform precise control on an image requiring high resolution.

Figure 4:
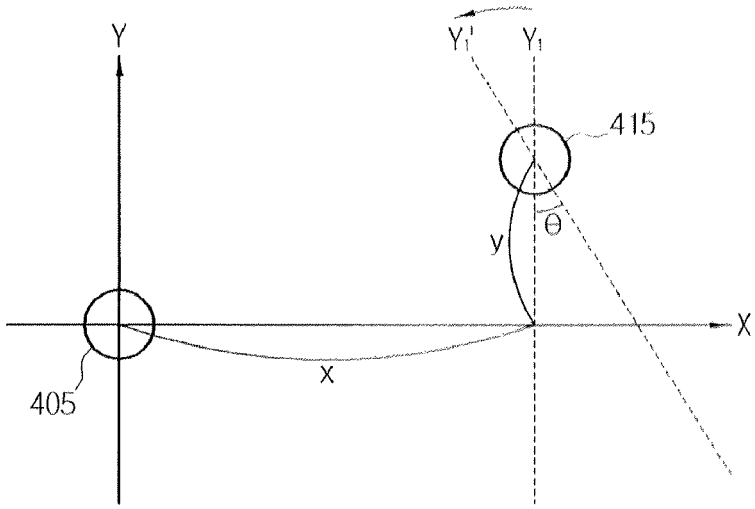
FIG. 4 is a view illustrating one example of a method to measure the degree of overlap between nozzles.

FIG. 4 is a view illustrating a method to measure the degree of overlap between nozzles. Referring to FIG. 4, a center coordinate values (0, 0) of a nozzle 405 of the first head chip 310 and center coordinate values (x, y) of a nozzle 415 of the second head chip 320 may be measured. Referring to FIG. 3A, if the nozzle positioned on the right-hand upper portion of the first head chip 310 is set as a reference nozzle, the center coordinate values (x, y) of this nozzle are determined as (0, 0). In this case, a horizontal distance and a vertical distance between the reference nozzle and the nozzle positioned on the left-hand upper portion of the second head chip 320 may be measured. Here, as illustrated in FIG. 3A, the nozzle 405 on the upper right-hand portion of the first head chip 310 and the nozzle 415 on the upper left-hand portion of the second head chip 320 are spaced apart horizontally by at least a diameter of any one of the nozzles, so the degree of overlap between nozzles is 0 and nozzle alignment errors do not occur. This is merely one example, which can be modified by those skilled in the art in various ways, such as setting the reference nozzle differently from the reference as described above.

A y axis of the coordinate may be a line passing the nozzle 405 or a line on which nozzles are disposed substantially parallel to the feeding direction D or the rightmost side of the first head chip 310. However, it is possible that the y axis may have an angle with the feeding direction D or the rightmost side of the first head chip 310. And, an x axis of the coordinate may be a line perpendicular to the y axis.

Referring to FIG. 4, even though the center coordinate values (x, y) of the nozzle 415 of the second head chip are fixed, axis $Y_1$ of the nozzle 415 of the second head chip may be parallel to the Y axis, or may be inclined to the Y axis at a predetermined angle (θ), as much as axis $Y_2$.

Figure 5A:
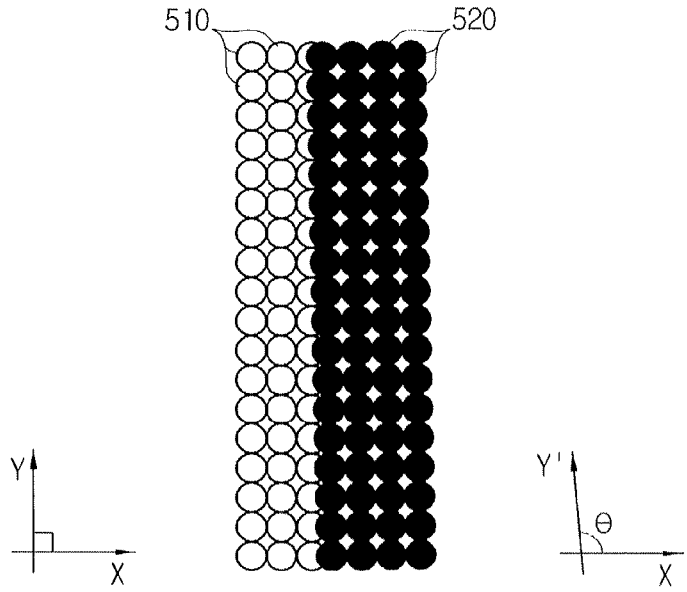
FIGS. 5A and 5B are views illustrating an overlap area of head chips.
Figure 5B:
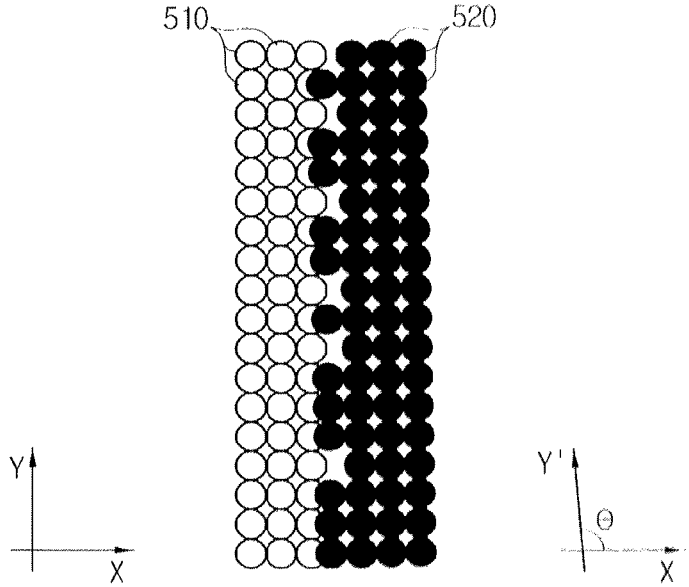

FIGS. 5A and 5B are views illustrating head chips having an overlap area. FIG. 5A illustrates a case in which a reference axis Y of the first head chip 510 and a reference axis $Y_2$ of the second head chip 520 are inclined to each other at a predetermined angle (θ), compared to the types of overlap varying in distance along a single X axis (or a single Y axis) illustrated in FIGS. 3A to 3E.

Referring to FIG. 5A, a first rate (amount) of overlap between one or more the first head chip 510 and one or more nozzles of the second head chip 520 which are positioned on an upper portion thereof adjacent to the boundaries between the first head chips 510 and the second head chips 520 is larger that a second rate of overlap between one or more nozzles of the first head chip 510 and one or more nozzles of the second head chip 520 which are positioned on a lower portion thereof adjacent to the boundaries between the first head chips 510 and the second head chips 520, such that resolution of an image can be improved, for example, a corresponding portion of the image can be formed on a printing medium, if printing of the image is performed on the printing medium in a printing operation. The corresponding portion of the image corresponds to the nozzles of the overlap. The corresponding portion of the image may be one or more clear color lines or one or more clear black lines.

The first rate can be linearly changed to the second rate. One of the first rate and the second rate is greater than the other one of the first rate and the second rate. It is possible that the first rate can be changed non-linearly to the second rate.

If a type of horizontal overlap (or vertical overlap) is a variable rate of the overlap between nozzles illustrated in FIG. 5A, a pattern different from the driving pattern of FIGS. 3A to 3E may be formed as illustrated in FIG. 5B. If the printing operation to drive the nozzles in a normal pattern, other than the pattern illustrated in FIG. 5B, clear black lines may occur or formed from the nozzles positioned on the lower portion than the nozzles positioned on the upper portion near the boundaries between the first head chips 510 and the second head chips 520. Therefore, the nozzles can be selected such that the number of the nozzles positioned on the lower portion to be turned on increase compared to the number of nozzles positioned on the upper portion to be turned on, according to information (or one or nozzle driving rates) pre-stored in a compensation table.

Figure 6A:
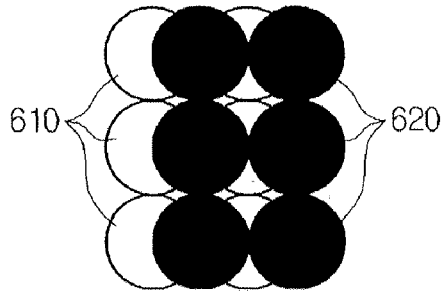
FIGS. 6A and 6B are views illustrating nozzle drive rates set diversely.
Figure 6B:
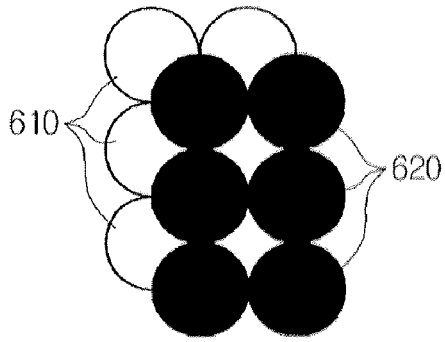

FIGS. 6A and 6B are views illustrating nozzle drive rates set diversely. When printing is performed on a printing medium as illustrated in FIGS. 6*a* and 6B, the number (amount or area) of nozzles overlapping each other in FIG. 6A is greater than the number (amount or area) of nozzles overlapping each other in FIG. 6B. In other words, black lines may cause a more serious degradation in quality in FIG. 6A than in FIG. 6B if the printing is performed according to a normal driving pattern rather than the driving patterns illustrated in FIGS. 3A to 3E or FIGS. 5A and 5B. The nozzle drive rates may thus be pre-stored in the compensation table in order to be set differently from each other.

The nozzle drive rates may also be set differently from each other according to the resolution of the image forming apparatus. In a case where the nozzles overlap each other and the black (color) lines occur on the printing medium, although the nozzle rates are set to be somewhat rougher in the case of a low resolution than in the case of a high resolution, the degradation of print such as black lines may not be recognized during a printing with the naked eyes. "Somewhat rougher" represents that the one or more lines are formed on the printing medium using the nozzles according to the nozzle rate to drive the nozzle of the pattern, and the formed one or more lines may be not lines with higher printing quality.

Likewise, the nozzle drive rates may be set differently from each other depending on whether the image forming apparatus is in a mono mode or a color mode or in one of a plurality of resolution modes. In other words, the nozzle drive rates may be set somewhat rougher in the color mode than in the mono mode. Although the case of the mono mode is explained above, the explanation is the same in the case of the color mode, except for the feature of the color mode that C, M, Y, and K ink droplets are ejected from each nozzle of one head with a time interval.

Figures 7, 8:
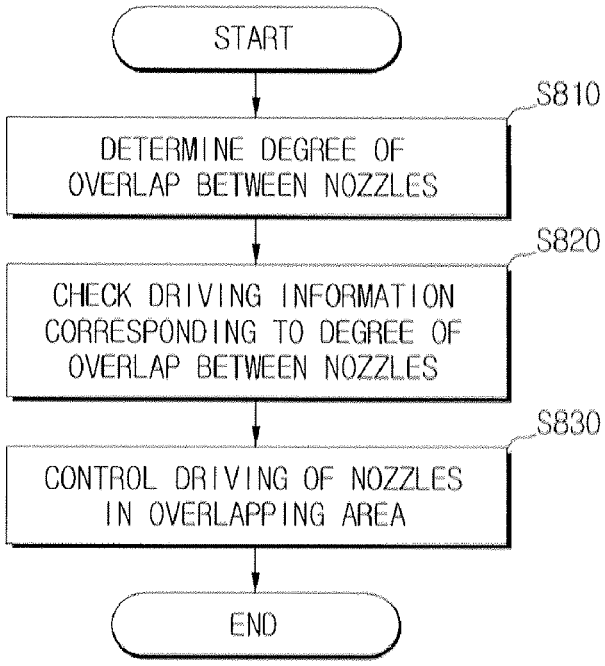
FIG. 7 is a view illustrating one example of a compensation table usable in an image forming apparatus according to the present general inventive concept.
FIG. 8 is a flowchart illustrating a method of compensating for alignment errors according to an exemplary embodiment of the present general inventive concept.

FIG. 7 is a view illustrating a compensation table usable in the image forming apparatus according to the present general inventive concept. Referring to FIG. 7, different data values are stored in the compensation table, respectively, according to the overlapping object, the degree of overlap between nozzles, the grade, and the table. The compensation table may also set in order that the overlapping objects, the degree of overlap between nozzles, the grade, and the table match each other.

The overlapping object represents chips relating to the overlap calculation, such as a first head chip overlapping a second head chip, or a second head chip overlapping a third head chip.

The degrees of overlap between nozzles are determined according to any one of the horizontal distance, the vertical distance, angles formed between respective X axes, and angles formed between respective Y axes, of the plurality of head chips, as described above. The degree of overlap between nozzles may thereby be stored as diverse forms of data such as −0.2, 1.8 and 3.7.

By way of example, a first grade may set a degree of overlap between 0 and 1, and a second grade may set a degree of overlap between 1 and 2, When more precise compensation for alignment errors is requested, a first grade may set a degree of overlap between 0 to 0.2, and a second grade may set a degree of overlap between 0.2 to 0.4 using diverse methods, in order to reflect the values to the right of a decimal point. The grade may also set in the case in which the degree of overlap has a positive value.

A plurality of tables may be provided to respond to the overlapping objects. In other words, the information generated between first head chips and second head chips may set as a first table, and the information generated between second head chips and third head chips may set as a second table.

Although not shown, the nozzle drive patterns according to the nozzle rates (%) may be stored in the compensation table. By way of example, referring to FIG. 3*c*, if the nozzle rates are 10%, a pattern may be set in which only one of nozzles in the first column on the left-hand side of the second head chips 320 overlapping with the first head chips 310 and having ten nozzles is turned on, wherein the number of cases available may be ten. If the nozzle rates are 20%, a pattern may be set in which only two nozzles in the first column on the left-hand side of the second head chips 320 is turned on, wherein the number of cases available may be forty-five. The nozzle drive patterns corresponding to all the number of cases available according to the nozzle rates (%) may be pre-stored in the compensation table as described above.

FIG. 8 is a flowchart illustrating a method of compensating for alignment errors according to an exemplary embodiment of the present general inventive concept.

The method of compensating for alignment errors according to an exemplary embodiment of the present general inventive concept determines the degree of overlap between nozzles of a plurality of head chips in operation S810, and checks driving information corresponding to the determined degree of overlap between nozzles, from a previously provided compensation table, in operation S820. Thereafter, the method controls the driving of the nozzles in the overlapping area according to the checked driving information in operation S830. Thus, if printing is performed later, the printing is performed in a state that the alignment errors of the nozzles are compensated for, making it possible to improve the print quality of an image.

Figure 9:
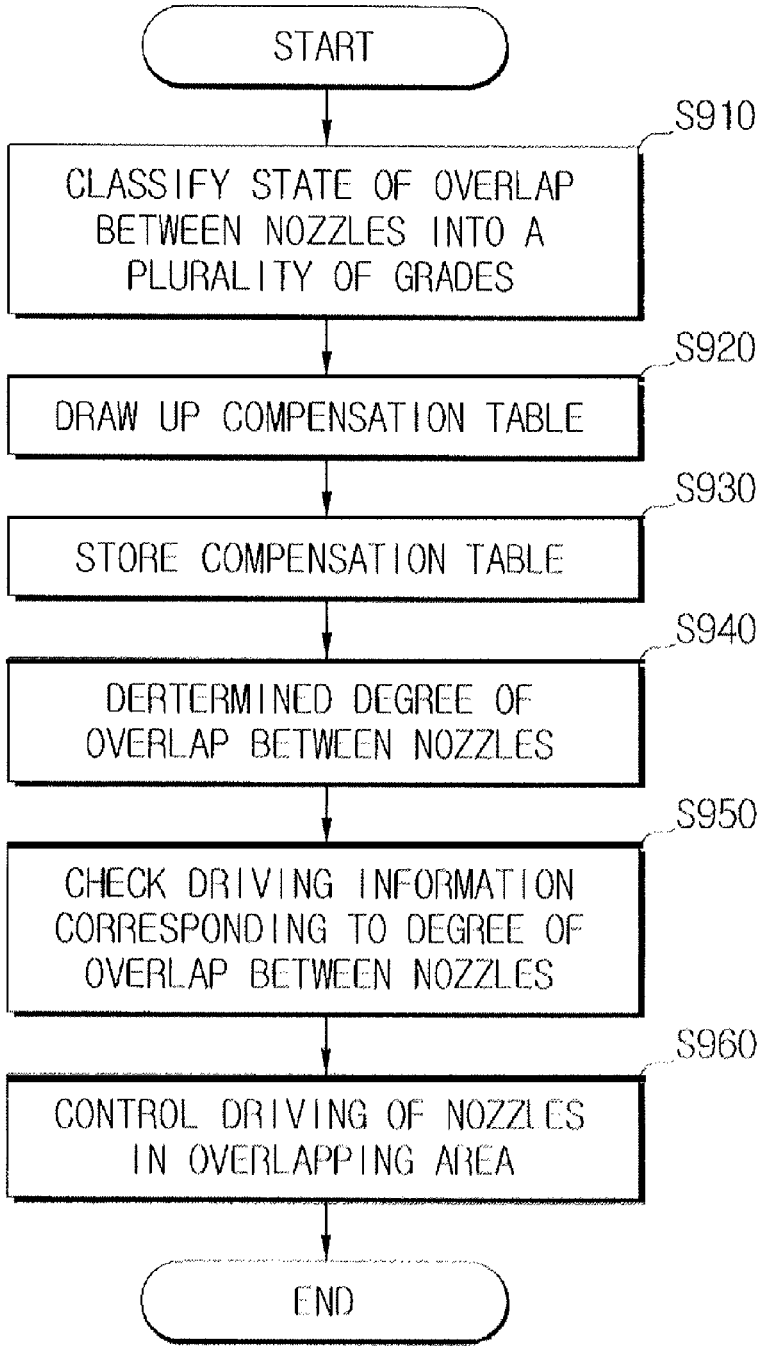
FIG. 9 is a detailed flowchart illustrating the method of FIG. 8.

FIG. 9 is a detailed flowchart illustrating the method of FIG. 8.

The method of compensating for alignment errors according to an exemplary embodiment of the present general inventive concept classifies the state of overlap between nozzles of head chips into a plurality of grades in operation S910, draws up a compensation table by matching different kinds of driving information for each of the plurality of grades in operation S920, and stores the drawn up compensation table in operation S930.

Thereafter, the same process as explained in FIG. 8 may be performed. More specifically, the degree of overlap between nozzles of a plurality of head chips is determined in operation S940, and driving information corresponding to the determined degree of overlap between nozzles is checked on a pre-provided compensation table in operation S950. Thereafter, the driving of the nozzles in the overlapping area is controlled according to the checked driving information in operation S960.

In other words, FIG. 9 may show the features that the information or data values for compensating for nozzle alignment errors are pre-stored in the compensation table and the information and the values match each other, prior to performing the methods explained in FIG. 8.

The present general inventive concept can also be embodied as computer-readable codes on a computer-readable medium. The computer-readable medium can include a computer-readable recording medium and a computer-readable transmission medium. The computer-readable recording medium is any data storage device that can store data as a program which can be thereafter read by a computer system. Examples of the computer-readable recording medium include read-only memory (ROM), random-access memory (RAM), CD-ROMs, magnetic tapes, floppy disks, and optical data storage devices. The computer-readable recording medium can also be distributed over network coupled computer systems so that the computer-readable code is stored and executed in a distributed fashion. The computer-readable transmission medium can transmit carrier waves or signals (e.g., wired or wireless data transmission through the Internet). Also, functional programs, codes, and code segments to accomplish the present general inventive concept can be easily construed by programmers skilled in the art to which the present general inventive concept pertains.

As described above, the present general inventive concept controls the driving of the nozzles in areas overlapping with each other using a previously provided compensation table, making it possible to minimize defects which may occur from the boundaries between head chips and thereby improve image quality.

Although a few embodiments of the present general inventive concept have been shown and described, it will be appreciated by those skilled in the art that changes may be made in these embodiments without departing from the principles and spirit of the general inventive concept, the scope of which is defined in the appended claims and their equivalents.

What is claimed is:

1. A method of compensating for alignment errors in which an inkjet image forming apparatus have a plurality of head chips each having a plurality of nozzles, in which some nozzles are arranged to overlap each other, the method comprising:

determining a degree of overlap between nozzles of the plurality of head chips;

checking driving information corresponding to the determined degree of overlap between nozzles, from a pre-provided compensation table; and controlling the driving of the nozzles in an overlapping area, according to the checked driving information, wherein the compensation table includes grades to classify the state of overlap between nozzles based on the number of overlapping nozzles, the direction of overlap, the distance of overlap and the angle of overlap, and the driving information matching the grades.

2. The method of claim 1, further comprising:

classifying the state of overlap between nozzles of the head chips into a plurality of grades;

drawing up the compensation table by matching different kinds of driving information for each of the plurality of grades; and storing the drawn up compensation table.

3. The method of claim 1, wherein the driving information includes at least one of the nozzle drive rates and nozzle drive patterns.

4. The method of claim 1, wherein the degree of overlap between nozzles is determined according to any one of horizontal distance, vertical distance, angles formed between respective X axes, and angles formed between respective Y axes of the plurality of head chips.

5. The method of claim 1, wherein the controlling of the driving of the nozzles in the overlapping area comprises driving the nozzles corresponding to at least one of the driving rates or the driving patterns with respect to at least one head chip of two head chips overlapping with each other, if printing is initiated.

6. An inkjet image forming apparatus, the apparatus comprising:

a plurality of head chips each having a plurality of nozzles, in which some nozzles are arranged so as to overlap with each other;

a storage unit stored with a compensation table in which driving information corresponding to the degree of overlap between nozzles is recorded; and a control unit to check the driving information corresponding to the degree of overlap between nozzles of the plurality of head chips and to control the driving of the nozzles in an overlapping area according to the checked driving information, wherein the compensation table includes grades to classify the state of overlap between nozzles based on the number of overlapping nozzles, the direction of overlap, the distance of overlap and the angle of overlap, and the driving information matching the grades.

7. The apparatus of claim 6, wherein the degree of overlap between nozzles is determined according to any one of horizontal distance, vertical distance, angles formed between respective X axes, and angles formed between respective Y axes of the plurality of head chips.

8. The apparatus of claim 6, wherein the driving information includes at least one of nozzle drive rates or nozzle drive patterns.

9. The apparatus of claim 8, wherein the control unit drives the nozzles corresponding to at least one of the driving rates or the driving patterns with respect to at least one head chip of two head chips overlapping with each other, if printing is initiated.

10. An inkjet image forming apparatus, the apparatus comprising:

one or more first nozzles disposed on a first line;

one or more second nozzles disposed on a second line; and a control unit to determine a pattern according to an overlap between the one or more first nozzles and the one or more second nozzles, and to drive the one or more first nozzles according to the determined pattern, wherein the compensation table includes grades to classify the state of overlap between nozzles based on the number of overlapping nozzles, the direction of overlap, the distance of overlap and the angle of overlap, and the driving information matching the grades.

11. The apparatus of claim 10, wherein the overlap is a relative position between the first line and the second line.

12. The apparatus of claim 10, wherein the overlap is an angle formed between the first line and the second line.

13. The apparatus of claim 10, wherein the overlap is an area occupied by the one or more first nozzles and the one or more second nozzles.

14. The apparatus of claim 10, wherein the overlap is an overlap amount when the first line and the second line are parallel to each other.

15. The apparatus of claim 10, further comprising:

a first head chip mounted with the first nozzles; and a second head chip mounted with the second nozzles such that at least a portion of the second head chip overlap the first head chip.

16. The apparatus of claim 10, further comprising:

a plurality of head chips having a first head chip having the first nozzles and a second head chip having the second nozzles, wherein the first head chip and the second head chip are disposed adjacent to each other such that at least one of boundaries and areas of the first head chip and the second head chip overlap.

17. The apparatus of claim 10, further comprising:

a storage unit having a compensation table to store a plurality of patterns, wherein the control unit selects one of the plurality of patterns as the pattern according to the overlap.

18. The apparatus of claim 10, wherein the control unit determines the pattern according to the overlap and one of printing modes.

19. The apparatus of claim 10, wherein:

the pattern comprises a driving pattern to select a first number of the first nozzles to be used to eject ink to form an image and a second number of the first nozzles to be not used to eject ink; and the first number of the first nozzles and the second number of the first nozzles alternates along the first line.

20. The apparatus of claim 10, wherein:

the pattern comprises a driving pattern to select a first number of the first nozzles to be used to eject ink to form an image and a second number of the first nozzles to be not used to eject ink; and the first number of the first nozzles is greater than the second number of the first nozzles.

21. The apparatus of claim 10, wherein:

the pattern comprises one or more first patterns of the first nozzles to be driven and one or more second patterns of the first nozzles not to be driven; and at least one of the first patterns is disposed between the second patterns.

22. The apparatus of claim 10, wherein:

the pattern comprises one or more first patterns of the first nozzles to be driven and one or more second patterns of the first nozzles not to be driven; and the number of the first patterns is greater than the number of the second patterns.

23. The apparatus of claim 10, wherein:

the pattern comprises the number of selection of the first nozzles to be driven; and the number of selection of the first nozzles is variable along the first line according to a characteristic of the overlap.

* * * * *